US005716268A

United States Patent [19]

Strongin et al.

[11] Patent Number: 5,716,268

[45] Date of Patent: Feb. 10, 1998

[54] DEVICE FOR REMOVAL OF DELETERIOUS IMPURITIES FROM ROOM ATMOSPHERE

[75] Inventors: Andrei Semenovich Strongin, Moscow; Alexandr Mikhailovich Zhivov, Sankt-Peterburg; Evgeny Ovseevich Shilkrot, Moscow, all of Russian Federation; Bengt Gunnar Lindeström, Malmoe, Sweden

[73] Assignee: PlymoVent AB, Malmoe, Sweden

[21] Appl. No.: 800,799

[22] Filed: Feb. 18, 1997

[51] Int. Cl.[6] ..... B08B 15/02

[52] U.S. Cl. ..... 454/66; 454/189

[58] Field of Search ..... 454/66, 189

[56] References Cited

U.S. PATENT DOCUMENTS

| | | | |
|---|---|---|---|
| 2,565,933 | 8/1951 | Schneible . | |
| 4,450,756 | 5/1984 | Kling | 454/66 |
| 4,856,419 | 8/1989 | Imai . | |
| 5,312,296 | 5/1994 | Aalto et al. | 454/66 |

*Primary Examiner*—Harold Joyce
*Assistant Examiner*—Derek S. Boles
*Attorney, Agent, or Firm*—Gary M. Nath; Nath & Associates

[57] ABSTRACT

A device for removal of deleterious impurities from room atmosphere comprises an exhaust hood, a means for delivery of inflow air into the emission zone of deleterious impurities and incorporates slotted nozzles arranged around the perimeter of the hood and oriented towards the source of deleterious impurities, and an apparatus for distributing air from the delivery air duct to the slotted nozzles. The air-distributing apparatus has the form of a distributing chamber disposed in the central part of the hood, communicating with the delivery air duct and provided with pressure branch pipes, one per slotted nozzle, connected, each,;with the corresponding nozzle at the point equidistant from the ends of said nozzle. In a preferable embodiment the nozzles are provided with cellular attachments and the slot width "b" of each nozzle complies with the following ratio:

$$b = F:\{P[45\,(F/PH)^2 \cdot (0.566\sqrt{H/b - 1}\,)^2 - 0.25(1 + 0.566\sqrt{H/b}\,)^2]\},$$

where b—nozzle width, m;

F—cross-sectional area of hood, sq.m;

P—hood perimeter, m;

H—height of hood above source of deleterious impurities.

3 Claims, 2 Drawing Sheets

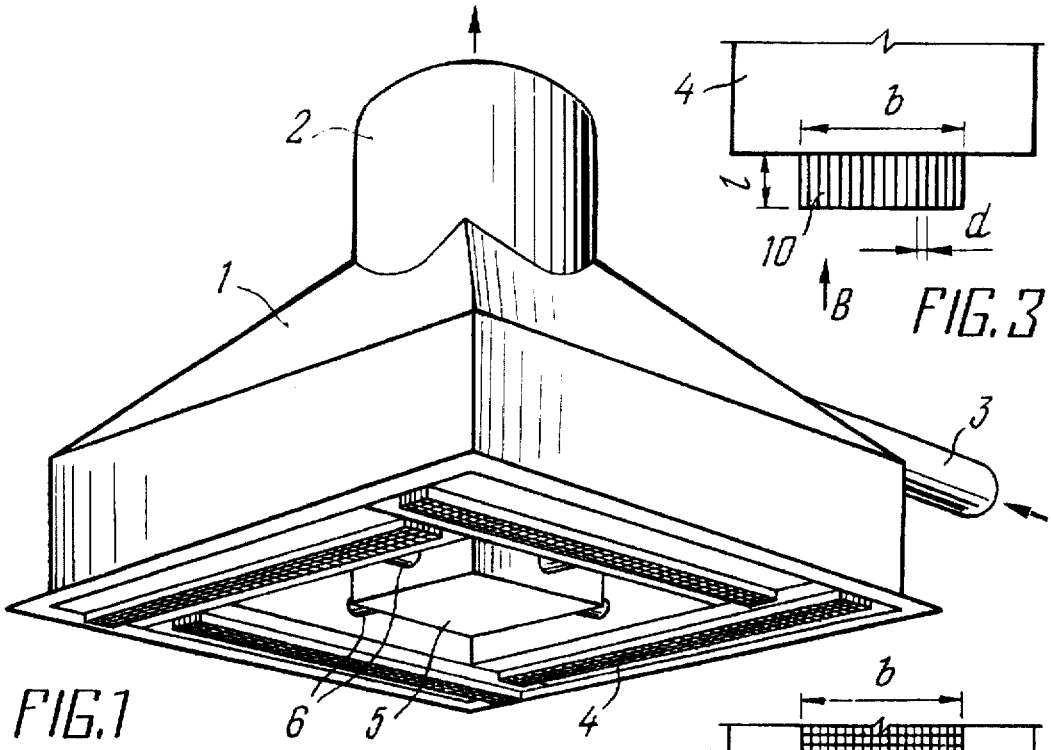
FIG.1
FIG.3
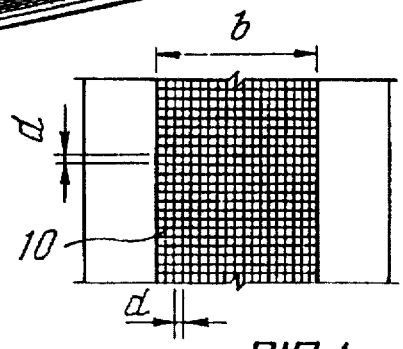
FIG.4
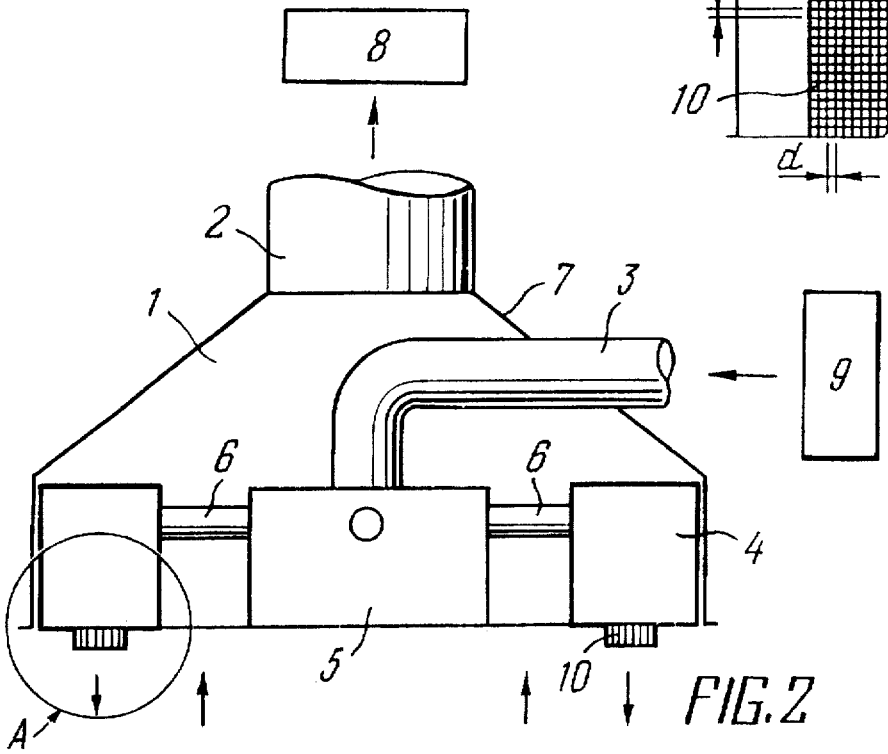
FIG.2

DEVICE FOR REMOVAL OF DELETERIOUS IMPURITIES FROM ROOM ATMOSPHERE

THE SPECIFICATION

1. Field of the Invention

The invention to ventilation systems and, more particularly, to a device for removal of deleterious impurities from room atmosphere locally, in the zone of their emission.

2. Discription of the Prior Art

Known in the prior art is a device for removal of deleterious impurities from room atmosphere (U.S. Pat. No. 2,565,933) comprising an exhaust hood and a means for delivery of inflow air in the form of a number of slotted nozzles combined by a delivery air duct. Said means build up an air screen which localizes the emission zone of deleterious impurities.

However, this device is noted for a low efficiency due to unstable localization of deleterious impurities since their emission zone is fenced off at one side only. Besides, employment of this device has inherent difficulties in formation of stable jets escaping from the slotted nozzles and forming an air screen. The level reached by the jets is unknown whereas efficient cleaning is impossible unless the jets reaching the room floor level become so weak that they turn inward just at this level, flow into the drawout opening, and entrain the emitted deleterious impurities.

There is another known device for removal of deleterious impurities from room atmosphere (U.S. Pat. No. 4,856,419) which comprises an exhaust hood, a means for delivery of inflow air into the deleterious impurities emission zone. Said means being comprised of slotted nozzles arranged around the hood perimeter and oriented towards the source of said impurities, and an apparatus for distribution of air from the delivery air duct to the slotted nozzles. Said apparatus in the known device has the form of a manifold arranged around the hood periphery or made of four individual branch pipes, each connected to the end of each of the four slotted nozzles disposed on the sides of the rectangular hood.

Unlike the above-described device, this device provides for a more reliable localization of the emission zone of deleterious impurities since the air screen is formed here around the entire hood periphery, enveloping said zone from all sides.

At the same time, just as it is the preceding case, the jets discharged from the slotted nozzles are unstable and uncontrollable. If air is delivered through one hole into a single manifold or into the ends of slotted nozzles, different points along the length of the nozzle slot find themselves in unequal conditions with respect to the head of the delivered air. This leads to the necessity for determining the air flow rate on the basis of the conditions prevailing in the points with a minimum air head which results in unproductive expenditures.

SUMMARY OF THE INVENTION

It is an object of the invention to ensure a uniform head of air throughout the entire perimeter of the hood.

It is a further object of the invention to form stable jets so as to provide an air curtain down to the floor level of the room in which there is a source of deleterious impurities.

These and other objects are attained in the device for removal of deleterious impurities from room atmosphere comprising an exhaust hood, a means for delivery of inflow air into the emission zone of deleterious impurities comprised of slotted nozzles arranged around the perimeter of the hood, and an apparatus for distribution of air from the delivery air duct to the slotted nozzles wherein, according to the invention the air distributing apparatus is made as a distributing chamber disposed in the center of the hood, communicating with the delivery air duct and fitted with delivery branch pipe for each slotted nozzle, each of said branch pipes being connected to the corresponding nozzle at the point which is equidistant from the ends of said nozzle.

In order to ensure turning of jets at the level of the deleterious impurities source. It is good practice that the width "b" of slot in each nozzle be selected on the condition that:

$$b = F:\{P[45(F/PH)^2 \cdot (0.566\sqrt{H/b} - 1)^2 - 0.25\,(1 + 0.566\sqrt{H/b})^2]\}, \quad (1)$$

where b—width of nozzle, m;

F—cross-sectional area of hood, sq.m;

P—hood perimeter, m;

H—height of hood above source of deleterious impurities, m.

In order to promote uniformity and to smooth-out the turbulence of jets, it is also expedient that each slotted nozzle be provided with a cellular attachment wherein the length of each cell relates to its equivalent diameter as at least 10:1.

The device for removal of deleterious impurities from room atmosphere realized in accordance with the present invention ensures:

- uniform head of inflow air throughout the hood perimeter;
- high efficiency of localizing deleterious impurities due to turning and locking of inflow jets at the level of the source of deleterious impurities, the width of the slotted nozzle being determined from ratio (1);
- stability of localization and removal of deleterious impurities due to a stable low-turbulent jet formed by the cellular attachment, and uniformity of suction speeds due to disposing the distributing chamber in the maximum zone of the suction sprectrum;
- lower flow rate of removed air due to lower ejecting capacity of inflow jets ensured by the use of cellular attachments with the relation of the cell length to its equivalent diameter not under 10:1;
- lower material content due to a smaller size of air ducts where pressure pipes are connected to the middle of the nozzles.

BRIEF DESCRIPTION OF THE DRAWINGS

Now the invention will be elucidated by a description of its embodiments with reference to the accompanying drawings wherein:

FIG. 1 is an isometric view of the device for removal of deleterious impurities from room atmosphere, according to the invention;

FIG. 2—same as in FIG. 1, schematic, longitudinal section;

FIG. 3—Fragment A in FIG. 2 enlarged;

FIG. 4—bottom view along arrow B in FIG. 3;

DETAILED DESCRIPTION OF THE INVENTION

Figure 6:
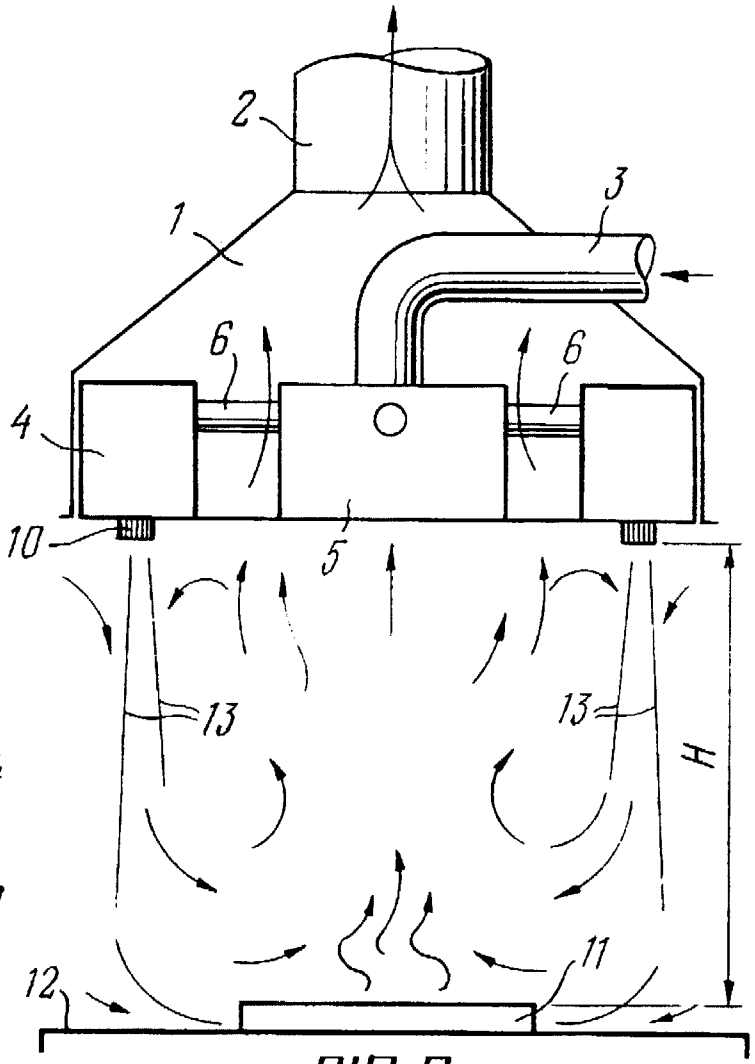
FIG. 6 shows the operating principle of the device, according to the invention, schematic view.

An embodiment of the device for removal of deleterious impurities from room atmosphere illustrated in FIGS. 1 and 2 comprises a hood 1 with an exhaust air duct 2 connected to its upper part and a delivery air duct 3 connected to its side wall. Arranged around the perimeter of the hood 1 are four identical slotted nozzles 4 oriented towards the source of deleterious impurities (not shown in FIGS. 1, 2), in this case, downward. The device also has an apparatus for distribution of air from the delivery air duct 3 to the slotted nozzles 4 made in the form of a distributing chamber 5 disposed in the central part of the hood 1, symmetrically with its central vertical axis, said chamber having the form of a parallelepiped, communicating with the delivery air duct 3 and equipped with pressure branch pipes 6, one per slotted nozzle 4, in this particular case four pipes, each communicating with the corresponding nozzle 4 at the point equidistant from the ends of said nozzle. The delivery air duct 3 passes through the side wall 7 of the hood 1 and is connected with the distributing chamber 5 in the center at the top while the pressure branch pipes 6 are connected at one end to the side walls of the chamber 5, perpendicularly to, and symmetrically with, the vertical axis of the hood 1. The other ends of the branch pipes 6 are connected to the midpoints to the slotted nozzles 4. The device also incorporates a drawout fan 8 installed in the exhaust air duct 2 and a blower 9, for example, a radial fan installed in the delivery air duct 3.

Each slotted nozzle 4 has a cellular attachment 10 (FIGS. 3, 4) with the relation of length "l" of each cell to its equivalent diameter of at least 10:1.

The slot width "b" of each nozzle 4 must comply with the following ratio:

$$b = F:\{P[45\,(F/PH)^2\cdot(0.566\sqrt{H/b-1})^2-(0.25(1+0.566\sqrt{H/b})^2]\},$$

where b—nozzle width, m;

F—cross-sectional area of hood, sq.m;

P—hood perimeter, m;

H—height of hood above the source of deleterious impurities, m.

Figure 5:
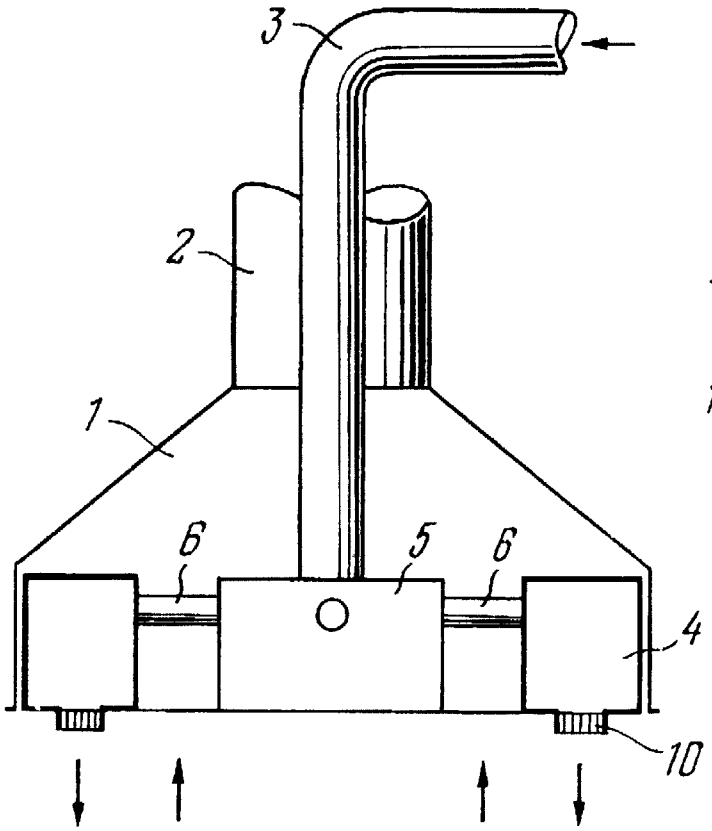
FIG. 5—same as in FIG. 2 with a different position of the delivery air duct.

FIG. 5 shows another embodiment of the device, according to the invention, wherein, unlike the arrangement illustrated in FIGS. 1, 2, the delivery air duct 3 is brought into the space under the hood 1 through the wall of the exhaust air duct 2 and similarly to the arrangement in FIGS. 1 and 2, is bent at a right angle and brought to the upper wall of the distributing chamber 5.

The device functions as follows.

The device for removal of deleterious impurities, according to the invention, is positioned above the source of emission 11 of deleterious impurities located on a base 12 at a height H from the level of the source 11 as illustrated in FIG. 6.

The inflow air supplied by the blower 9 (not shown in FIG. 6) flows through the delivery air duct 3 into the distributing chamber 5 and is distributed through the delivery branch pipes 6 among the slotted nozzles 4. Having passed through the cellular attachment 10, air enters the room in the form of stable low-turbulent jets 13 which fence off the source 11 of deleterious impurities from the working zone of the room.

When the exhaust hood 1 is installed at a height 11 above the source 11 of deleterious impurities, said height being determined from the ratio (1), the inflow jets turn actually at the level of said source 11. The position of the distributing chamber in the central part of hood 1 (maximum of suction spectrum) ensures a uniform suction velocity thus avoiding the undesirable marginal effects, i.e. stalling of the flow and swirling at the edges of the hood 1.

As the inflow jets 13 reach the source 11, the rarefaction built up by the drawout fan 8 (not shown in FIG. 6), turns said jets 13 and locks them (shown by curved arrows in FIG. 6) thus effectively localizing any deleterious impurities. Contaminated air enters under the exhaust hood 1 and is discharged from the room through the exhaust air duct 2. This creates circulation of air in the room around the source 11 which makes it possible to use both treated and non-treated air (outside air, recirculating air, etc) in the capacity of the inflow air.

The embodiment of the device shown in FIG. 5 functions on the same lines as described above. The design shown in FIG. 5 is more compact and is preferable provided the ceiling of the room is sufficiently high.

The device, according to the invention, is simple to manufacture since it can be made from standard units (distributing chamber, pressure branch pipes, nozzles with attachments, etc.).

Besides, the device is easy to service because the air flow through the slotted nozzles 4 is easily adjusted owing to a central layout of the distributing chamber 5 and symmetrical pressure branch pipes 6.

What is claimed is:

1. A device for removal of deleterious impurities from room atmosphere in a room where there is a source of deleterious impurities, said device comprising:

an exhaust hood arranged to be disposed at a distance from said source of deleterious impurities;

a means for delivery of air from an inflow air duct to the zone in said room enveloping said source of deleterious impurities;

said means for delivery of air which includes at least two slotted nozzles each having a first and a second butt ends and a slot-type opening extending over the length of the nozzle between said butt ends, said nozzles being arranged around the periphery of said hood and oriented with said slot-type openings towards said source of deleterious impurities, as well as an apparatus for distribution of air from said inflow air duct to said slotted nozzles;

said apparatus which includes:

a distribution chamber disposed in the central portion of the space under said hood and having an inlet opening communicated with said inflow air duct and outlet openings for each of said slotted nozzles;

delivery branch pipes for each of said slotted nozzles, each having a first and a second open ends so that said first ends thereof are communicated each with a corresponding outlet opening of the distribution chamber and said second ends thereof are communicated each with a corresponding slotted nozzle at the point of that nozzle which is equidistant from the ends of said nozzle.

2. The device according to claim 1, wherein said slot-type opening of said nozzle has a width thereof selected so as to comply with the following ratio:

$$b = F:\{P[45\,(F/PH)^2 \cdot (0.566\sqrt{H/b - 1})^2 - 0.25(1 + 0.566\sqrt{H/b})^2]\},$$

where b=width of said slot-type opening, m;

F=cross-sectional area of the hood around the perimeter thereof, $m^2$;

P=perimeter of the hood, m; and

H=height of the hood above the source of deleterous impurities, m.

3. The device according to claim 1, wherein each of said slotted nozzles has a cellular attachment, the ratio between the length of each cell of said attachment and the equivalent diameter thereof being equal, to at least 10:1.

* * * * *

UNITED STATES PATENT AND TRADEMARK OFFICE

CERTIFICATE OF CORRECTION

PATENT NO. : 5,716,268

DATED : February 10, 1998

INVENTOR(S) : Strongin et al.

It is certified that error appears in the above-identified patent and that said Letters Patent is hereby corrected as shown below:

Title page, item [57],

In the Abstract:

Please correct the equation on line 19 by replacing "$\sqrt{H/b-1}$" with --$\sqrt{H/b}$ - 1--.

In the Claims:

Please correct claim 2, line 6, by replacing "$\sqrt{H/b-1}$" with --$\sqrt{H/b}$ - 1--.

Signed and Sealed this

Second Day of June, 1998

*Attest:*

Bruce Lehman

BRUCE LEHMAN

*Attesting Officer*

*Commissioner of Patents and Trademarks*